United States Patent [19]

Fadden et al.

[11] 4,121,246

[45] Oct. 17, 1978

[54] GROUND IMPACT POINT PREDICTION SYSTEM CONCEPT FOR AIRDROPS

[75] Inventors: Delmar McLean Fadden, Kent; Alvin Richard Habbestad, Seattle; James Edwin Veitengruber, Bellevue, all of Wash.

[73] Assignee: The Boeing Company, Seattle, Wash.

[21] Appl. No.: 822,753

[22] Filed: Aug. 8, 1977

Related U.S. Application Data

[63] Continuation-in-part of Ser. No. 726,870, Sep. 27, 1976, abandoned.

[51] Int. Cl.[2] ..... H04N 7/18

[52] U.S. Cl. ..... 358/103; 340/27 NA; 364/462

[58] Field of Search ..... 358/103; 340/27 R, 27 NA; 364/462

[56] References Cited

U.S. PATENT DOCUMENTS

| | | | |
|---|---|---|---|
| 3,668,622 | 6/1972 | Gannett | 358/103 |
| 3,689,741 | 9/1972 | Sjöberg | 364/462 |
| 3,886,306 | 5/1975 | Fayard | 358/103 |

*Primary Examiner*—Howard W. Britton
*Attorney, Agent, or Firm*—Bernard A. Donahue

[57] ABSTRACT

The present invention utilizes a conventional aircraft landing and approach indicator in conjunction with a pilot controllable television camera and supporting aircraft computer for tracking an airdrop target and displaying the locus of payload ground impact points directly on the television image of the terrain being approached by the aircraft. The airdrop information is presented in such a manner which does not distract the pilot from the basic task of flying the aircraft by providing automatic calculation and continuous automatic updating of the airdrop information with respect to meteorological and aircraft flight path characteristics.

3 Claims, 4 Drawing Figures

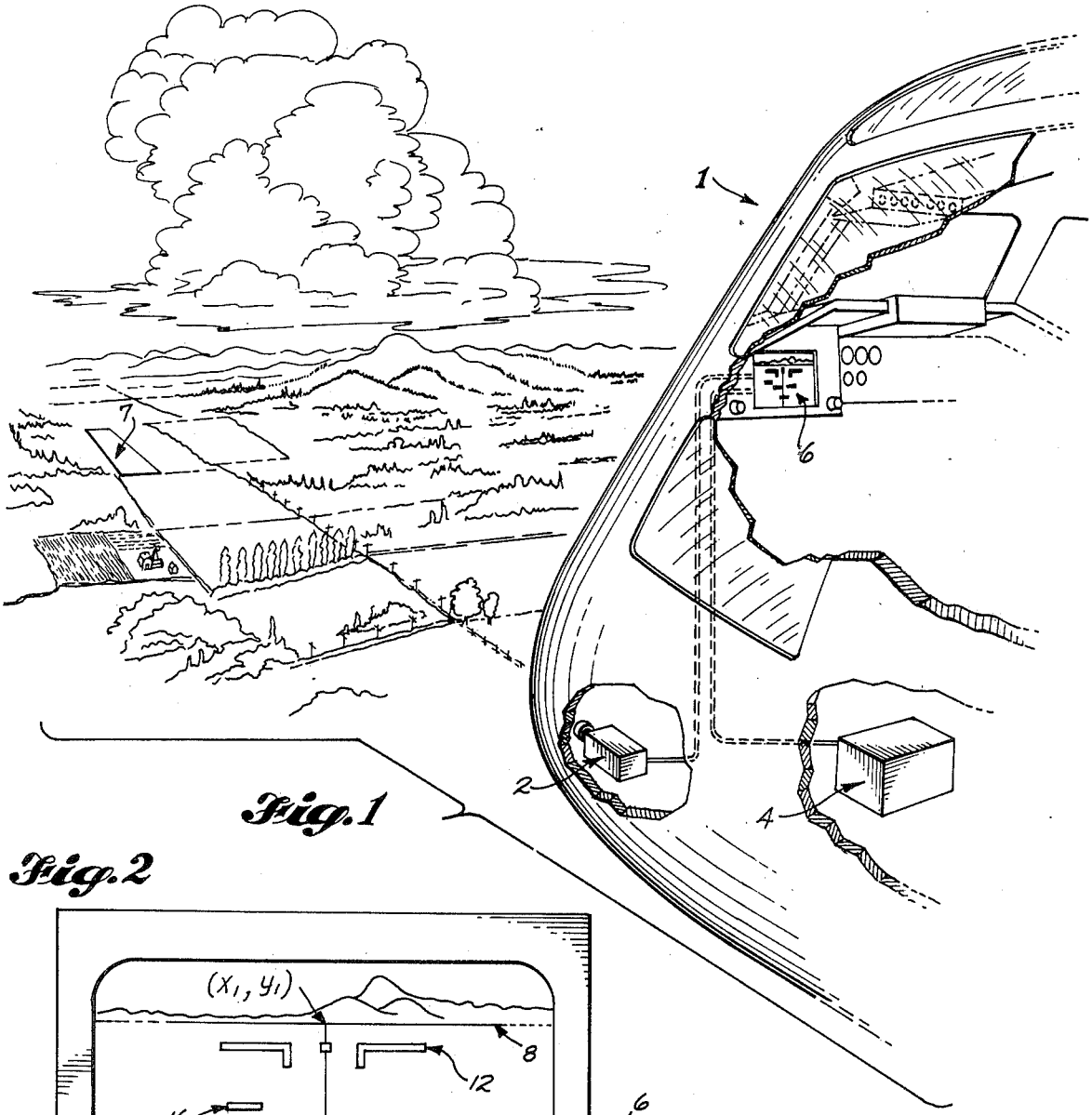
Fig. 1
Fig. 2
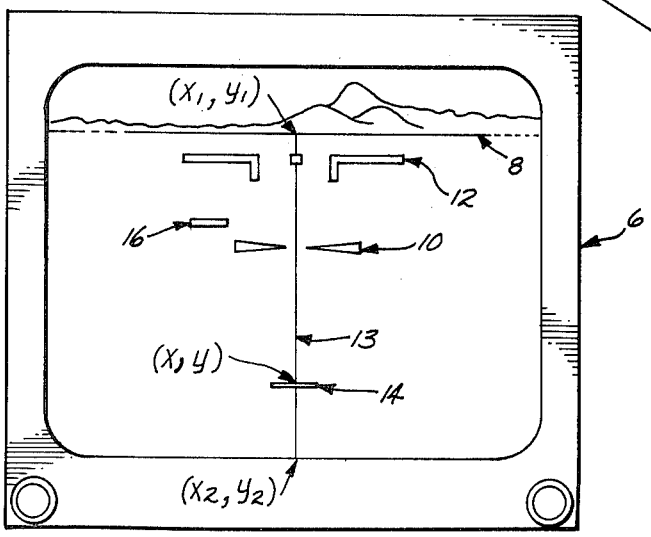

GROUND IMPACT POINT PREDICTION SYSTEM CONCEPT FOR AIRDROPS

FIELD OF THE INVENTION

This is a continuation-in-part of application Ser. No. 726,870, filed Sept. 27, 1976, now abandoned.

The present invention relates to a system for computing and displaying the ground impact points of airdrop payloads.

BACKGROUND OF THE INVENTION

Currently, the timing required for airdrop target approach and payload release is obtained from computed air release point diagrams. The generation of these diagrams is initially accomplished, prior to take-off, by extensive manual calculations, and after take-off by periodic manual updating of these calculations. Preflight calculations, in addition to those involving flight path characteristics, include estimates of crosswind, payload and parachute characteristics and typically require several hours to perform. After the target has been visually acquired, the pilot provides the flight guidance to the target in response to verbal instructions from the navigator. Visual target acquisition and guidance to the airdrop target require a minimum cockpit crew consisting of two pilots and a navigator.

On current tactical transport aircraft, such as the YC-14, only two crewman, the pilot and the co-pilot, are available to perform these tasks. As a result, the manual airdrop operations of the three man crew cannot simply be allocated between a two pilot crew without creating an excessive workload for the pilots.

Accordingly, it is an object of this invention to reduce the workload on a flight crew in an airdrop mission to a level where a two-man crew can expeditiously and safely handle the situation.

A further object of this invention is to present the airdrop guidance information in a manner which does not distract the pilot from the basic task of flying the aircraft.

A still further object of the present invention is to provide automatic and continuous airdrop guidance information with respect to meteorological and aircraft flight path characteristics through onboard avionics systems.

DESCRIPTION OF THE DRAWINGS

FIG. 1 is a pictorial view of the present invention showing the airdrop target on the terrain below the aircraft.

FIG. 2 shows the display of the airdrop target without the effects of a crosswind.

DESCRIPTION OF THE PREFERRED EMBODIMENT

Figure 3:
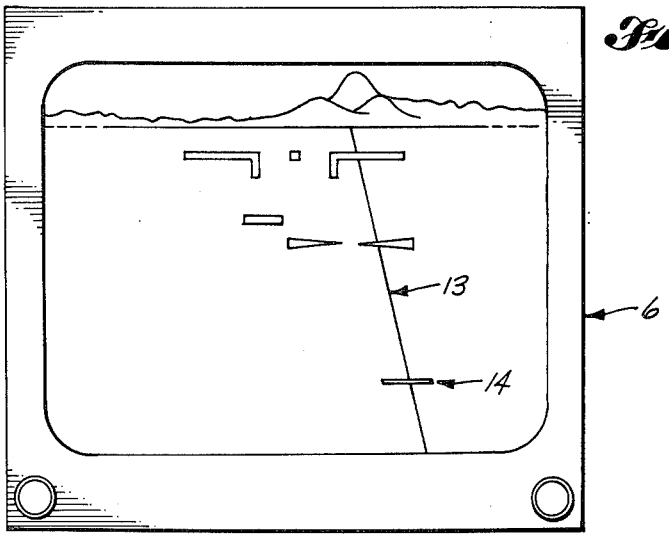
FIG. 3 shows the display of the airdrop target when a crosswind from the left occurs.

The present invention is a self-contained system that displays to an aircraft crew member, normally the pilot, the proper point of impact for an airborne load. The preferred embodiment, shown generally at 1 in FIG. 1, includes television camera 2, aircraft computer 4, and aircraft electronic attitude director indicator (hereinafter EADI) 6. Such EADI systems are known in prior art (U.S. Pat. No. 3,668,622 to Annin et al) and consequently will not be described. Computer 4 is a standard navigation or air data system computer, typically one conforming to ARINC 561 standards.

On tactical aircraft, exemplified by the YC-14, aircraft attitude, velocity and energy management information as monitored by computer 4, is visually presented to crew members on EADI 6. Additionally, during landing and approach maneuvers, this information is superimposed on a television picture of the environment directly ahead of the aircraft. This information provides the pilot precise approach and aircraft performance information.

The television scene is derived from television camera 2 located within the lower edge of the aircraft's radome. With reference to FIG. 2, the standard set of symbols displayed on EADI 6 include horizon line 8, flight path angle or velocity vector 10, airplane pitch symbol 12, and flight path acceleration 16.

In the preferred embodiment, the invention utilizes television camera 2, EADI 6, including the existing symbology, to provide imagery of the airdrop zone as the aircraft approaches the airdrop target. The orientation of television camera is fixed along the yaw axis of the aircraft but is movable from 0° to 90° below the pitch axis of the aircraft. This is accomplished by known servo system techniques (not shown) and is controlled on the flight deck usually by the pilot. In an alternate embodiment, the orientation of camera 2 could be a direct function of the aircraft speed brake type lever position; specifically full aft lever position would correspond to zero degrees down camera tilt, and full forward lever position would correspond to 90° down camera tilt.

In addition, superimposed over the imagery of the terrain below the aircraft and EADI symbology, is the locus of instantaneous impact points represented by line 13, and the instantaneous impact point represented by line 14. The locus of instantaneous impact points 13 (see FIG. 2) provides the pilot with an indication of the ground track of the aircraft and represents the line along which airdrop loads would impact the ground if no lateral disturbances, such as crosswinds, exist. If such a condition exists, as shown in FIG. 3, line 13 is shifted laterally or angularly by computer 4 to compensate for the effects of crosswind and aircraft altitude. The instantaneous impact point 14 moves along line 13 and is an indication of the point of impact of an airdrop load if released instantaneously. Computer 4 also generates this indicator through a computation involving aircraft parameters and load characteristics.

Typically, the airdrop payload and airdrop parachute characteristics are entered into computer 4 prior to take-off. When operating in the airdrop mode, with television camera 2 in operation, computer 4 monitors crosswind, aircraft heading, aircraft drift angle, attitude and airspeed from conventional aircraft avionic systems. These parameters are used to compute and display the locus of instantaneous impact points 13 and the instantaneous impact point 14 as well as provide the necessary correction to line 13 to compensate for changing meteorological conditions.

With reference to FIG. 2, computer 4 calculates the impact points 13 and instantaneous impact point 14 utilizing the equations as contained in TABLES 1, 2 and 3. TABLE 4 contains a definition of nomenclature. Also with reference to FIG. 2 and the above tables, the coordinates $(x,y)$ correspond to point 14, $(x_1,y_1)$ correspond to the top of line 13, and $(x_2,y_2)$ correspond to the bottom of line 13.

Figure 4:
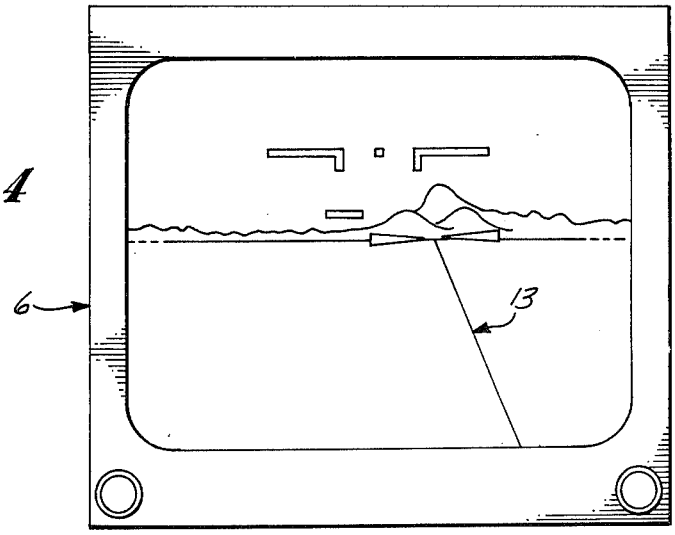
FIG. 4 shows the display when the camera angle corresponds to its approach landing position.

In a typical airdrop maneuver, the pilot begins the approach to airdrop zone 7 with camera 2 in the approach landing position as shown in FIG. 4. In the approach landing position, impact point 14 is out of the field of view of the television imagery.

As the aircraft nears airdrop zone 7 (see FIG. 1), camera 2 is tilted downward from its approach landing position to track the airdrop target and bring impact point 14 into the field of view of EADI 6. Tilt angle of camera is normally controlled by the pilot as has been described. Instantaneous impact point 14, and locus of impact points 13 of the airdropped item are calculated by computer 4, based on the described parameters, and superimposed on the image of drop zone 7. The pilot then flies the aircraft to drop zone 7, adjusts the aircraft's path utilizing existing symbols 10 and 14 such that line 13 overlays drop zone 7 and waits for line 14 to overlay drop zone 7 to release the airdrop load. The pilot with this direct viewing capability can then release the airdrop load as he directly views the impact point.

TABLE 2

| | LOCATION ON SCREEN | EQUATIONS FOR EADI AIRDROP SYMBOLOGY — PREDICTED INSTANTANEOUS IMPACT POINT: x | y |
|---|---|---|---|
| NO ROLL COMPENSATION | OFF TOP OF SCREEN | $x_1$ | $y_{MAX}$ |
| | ON SCREEN | $D.A. + TAN^{-1}\left(\frac{XDP}{YDP'}\right)$ | $-TAN^{-1}\left(\frac{h}{YDP}\right) - \theta - CTA$ |
| | OFF BOTTOM OF SCREEN | $x_2$ | $y_{MIN}$ |
| ROLL COMPENSATED | OFF TOP OF SCREEN | $x_1 \cos\phi - y_{MAX}\sin\phi$ | $x_1 \sin\phi + y_{MAX}\cos\phi$ |
| | ON SCREEN | $\left[D.A. + TAN^{-1}\left(\frac{XDP}{YDP'}\right)\right]\cos\phi - \left[-TAN^{-1}\left(\frac{h}{YDP}\right) - \theta - CTA\right]\sin\phi$ | $\left[D.A. + TAN^{-1}\left(\frac{XDP}{YDP'}\right)\right]\sin\phi + \left[-TAN^{-1}\left(\frac{h}{YDP}\right) - \theta - CTA\right]\cos\phi$ |
| | OFF BOTTOM OF SCREEN | $x_2 \cos\phi - y_{MIN}\sin\phi$ | $x_2 \sin\phi + y_{MIN}\cos\phi$ |

NOTE: $YDP' = \sqrt{(YDP)^2 + (h)^2}$

TABLE 2

EQUATIONS FOR EADI AIRDROP SYMBOLOGY

| | LOCATION ON SCREEN | LOWER END OF LINE 13 $x_2$ | LOWER END OF LINE 13 $y_2$ |
|---|---|---|---|
| NO ROLL COMPEN-SATION | OFF TOP OF SCREEN | (NOT FEASIBLE) | (NOT FEASIBLE) |
| | ON SCREEN | $\left[(D.A.)+TAN^{-1}\left(\frac{XDP}{YDP'}\right)\right]\left[\frac{y_{MIN}}{-TAN^{-1}\left(\frac{h}{XDP}\right)-\theta+CTA}\right]$ | $y_{MIN}$ |
| | OFF BOTTOM OF SCREEN | $\left[\frac{y_{MIN}-y_1}{-TAN^{-1}\left(\frac{h}{YDP}\right)-\theta-CTA-y_1}\right]\left[D.A.+TAN^{-1}\left(\frac{XDP}{YDP}\right)-x_1\right]+x_1\Big]$ | $y_{MIN}$ |
| ROLL COMPEN-SATED | OFF TOP OF SCREEN | (NOT FEASIBLE) | (NOT FEASIBLE) |
| | ON SCREEN | $-y_{MIN}\sin\phi + \left[(D.A.)+TAN^{-1}\left(\frac{XDP}{YDP'}\right)\right]\left[\frac{y_{MIN}}{-TAN^{-1}\left(\frac{h}{XDP}\right)-\theta+CTA}\right]\cos\phi$ | $Y_{MIN}\cos\phi + \left[(D.A.)+TAN^{-1}\left(\frac{XDP}{YDP'}\right)\right]\left[\frac{y_{min}}{-TAN^{1}\left(\frac{h}{XDP}\right)-\theta+CTA}\right]\sin\phi$ |
| | OFF BOTTOM OF SCREEN. | $-y_{MIN}\sin\phi + \left\{\left[\frac{y_{MIN}-y_1}{-TAN^{-1}\left(\frac{h}{YDP}\right)-\theta-CTA-y_1}\right]\left[D.A.+TAN^{-1}\left(\frac{XDP}{YDP}\right)-x_1\right]+x_1\right\}\sin\phi$ | $y_{MIN}\cos\phi + \left\{\left[\frac{y_{MIN}-y_1}{-TAN^{-1}\left(\frac{h}{YDP}\right)-\theta-CTA-y_1}\right]\left[D.A.+TAN^{-1}\left(\frac{XDP}{YDP}\right)-X_1\right]+X_1\right\}\sin\phi$ |

TABLE 3

EQUATIONS FOR EADI AIRDROP SYMBOLOGY

| | Location On Screen | UPPER END OF LINE 13 $x_1$ | UPPER END OF LINE 13 $y_1$ |
|---|---|---|---|
| No Roll Compensation | Off Top of Screen | $\left(\frac{y_{MAX} - y_{MIN}}{-\theta + CTA - y_{MIN}}\right)(D.A. - x_2) + x_2$ | $y_{MAX}$ |
| | On Screen | D.A. | $-\theta + CTA$ |
| | Off Bottom Of Screen | (NOT FEASIBLE) | (NOT FEASIBLE) |
| Roll Compensated | Off Top of Screen | $-y_{MAX} \sin \phi + \left[\left(\frac{y_{MAX} - y_{MIN}}{-\theta + CTA - y_{MIN}}\right)(D.A. - x_2) + x_2\right] \cos \phi$ | $y_{MAX} \cos \phi + \left[\left(\frac{y_{MAX} - y_{MIN}}{-\theta + CTA - y_{MIN}}\right)(D.A. - x_2) + x_2\right] \sin \phi$ |
| | On Screen | $-(-\theta + CTA) \sin \phi + (D.A.) \cos \phi$ | $(-\theta + CTA) \cos \phi + (D.A.) \sin \phi$ |
| | Off Bottom Of Screen | (NOT FEASIBLE) | (NOT FEASIBLE) |

TABLE 4

NOMENCLATURE DEFINITION

| | | |
|---|---|---|
| D.A. | = | drift angle (deg.) |
| YDP | = | forward travel of airdopped load (from release point to impact point) (yards) |
| XPD | = | lateral travel of airdropped load (from release point to impact point) (yards) |
| $x_i$, $y_i$ | = | location of symbology on EADI screen (reference FIG. 2) (deg.) |
| $y_{MAX}$ | = | y-coordinate of top edge of viewable EADI area (deg.) |
| $y_{MIN}$ | = | y-coordinate of bottom edger of viewable EADI area (deg.) |
| $\theta$ | = | pitch attitude (deg.) |
| $\phi$ | = | roll attitude (deg.) |
| CTA | = | camera tilt angle ($-90° \leqq CTA \leqq 0°$) |
| h | = | altitude (feet) |

Accordingly, the foregoing disclosure and description thereof are for illustrative purposes only and do not in any way limit the invention which is defined only by the following claims.

What is claimed is:

1. A method for tracking and displaying an airdrop target point to the crew of an aircraft which comprises:

(a) displaying an image of the terrain ahead of an aircraft including the airdrop target point on an apparatus showing the aircraft flight path characteristics;

(b) generating a line representing the locus of instantaneous impact points of an airdrop load along the terrain and superimposing said line on said image;

(c) generating a line representing the instantaneous impact point of an airdrop load on the terrain and superimposing said line on said image; and, (d) aligning the flight path of the aircraft with said line representing the locus of instantaneous impact points until said line representing the instantaneous impact point overlays said airdrop target at which point an airdrop load is released.

2. The method of claim 1 wherein the step of generating a line representing the locus of instantaneous impact points includes imputing aircraft and airdrop load parameters into an aircraft computer and calculating said line.

3. The method of claim 1 wherein the step of generating a line representing the instantaneous impact point of an airdrop load includes imputing aircraft and airdrop loads into an aircraft computer and calculating said line.

* * * * *